114-242 SR
10/20/81 XR 4,295,437

United States Patent [19]
Mock, Jr. et al.

[11] 4,295,437
[45] Oct. 20, 1981

[54] AUTOMATIC FLARE SIGNAL APPARATUS

[76] Inventors: George W. Mock, Jr., 5315 Carinleigh, Houston, Tex. 77084; George W. Mock, Sr., 13206 Boca Raton, Houston, Tex. 77069

[21] Appl. No.: 78,914

[22] Filed: Sep. 26, 1979

Related U.S. Application Data

[63] Continuation-in-part of Ser. No. 937,473, Aug. 28, 1978, Pat. No. 4,205,619.

[51] Int. Cl.[3] ..... G08B 21/00
[52] U.S. Cl. ..... 116/202; 116/4; 116/67 R; 114/242; 340/29; 137/551
[58] Field of Search ..... 116/67 R, 81, 83, DIG. 40, 116/DIG. 34, 58 R, 212, 202, 208, 206, 214, 209, 277, 4, DIG. 7, 68; 114/242, 247, 252, 253; 340/29, 309, 309.4, 500, 531; 42/1 R; 102/31, 37.7; 137/551; 440/34

[56] References Cited

U.S. PATENT DOCUMENTS

| | | | |
|---|---|---|---|
| 662,774 | 11/1900 | Davis | 116/67 R |
| 2,789,501 | 4/1957 | Sawicki | 116/DIG. 40 |
| 2,810,120 | 10/1957 | Parker | 116/67 R |
| 3,428,942 | 2/1969 | Isaacson | 116/67 R |
| 3,759,094 | 9/1973 | Al | 340/29 |
| 3,764,971 | 10/1973 | Brobeck | 340/29 |
| 4,058,792 | 11/1977 | Soltesz | 116/26 |
| 4,205,619 | 6/1980 | Mock et al. | 116/67 R |

*Primary Examiner*—Gerald Goldberg
*Assistant Examiner*—Denis E. Corr

[57] ABSTRACT

An apparatus for indicating breakage of a tensioned rope, or chain or the like by firing flares or other warning signals. In the preferred embodiment, an auxiliary cable running parallel to the towing or mooring cable is used to actuate firing of a first flare and to simultaneously activate a timing mechanism. Said timing mechanism fires a series of flares in a predetermined sequence. This combination allows both an immediate indication of a hazard and quick localization and recovery of a detached boat or vehicle.

4 Claims, 7 Drawing Figures

AUTOMATIC FLARE SIGNAL APPARATUS

CROSS-REFERENCES TO RELATED APPLICATIONS

This application is a continuation-in-part of pending application Ser. No. 937,473 filed Aug. 28, 1978 now U.S. Pat. No. 4,205,619.

BACKGROUND OF THE INVENTION

1. Field of the Invention

The present invention relates generally to triggering a series of signals in response to the parting of towing or mooring lines. More particularly, the present invention relates to a mechanical firing mechanism for actuating flares in a timed sequence so as to indicate both that the towing lines have parted and to aid in locating and recovering detached vehicles.

2. Background of the Prior Art

It is common for a single tugboat to tow a plurality of barges. Since barges are usually unmanned, and broken tow lines often cause barges to become detached, the tug operator may not become aware that a barge has broken loose in time to avoid costly loss, harm or damage. Quick recovery of a barge is extremely important when the cargo is of a chemical or petroleum nature where spillage or loss would have a serious detrimental effect on the ecology. The dangers and likelihood of such unnoticed separation are greatly increased under conditions of limited visibility, particularly fog or dense rain or during night towing operations. Also barges typically present a very low visual and radar profile, especially when they are loaded. They tend to be easily hidden by high seas and can be difficult to find in inclement weather. Under these circumstances even a slight delay in discovering that a barge has broken its tow line can be disastrous because the free barge is quickly lost to view. Tugs have low maneuverability and are slow. Thus, to avoid damage in crowded shipping lanes, such as exist in navigable rivers, inland waterways and in most parts of the world, it is absolutely mandatory that any breakage of two lines be immediately discovered and the lost barge recovered even when weather conditions limit visibility.

The prior art in this field has conspicuously failed to provide a simple and reliable means for signaling the presence of a loose barge and in such a way as to aid its recovery. Known devices in this area, such as those disclosed in U.S. Pat. No. 3,727,212, issued to Jones, and U.S. Pat. No. 4,058,792, issued to Soltesz typically consist of complicated electro-magnetic signaling devices for indicating undesired motions of anchored boats. Such systems characteristically require sensor devices separate and apart from a ship's mooring or anchoring devices. The prior art known to the inventor does not teach an immediate signaling means combined with a time-delayed signaling means for promoting the rapid recovery of a loose vessel, such as a barge.

SUMMARY OF THE PRESENT INVENTION

The present invention discloses an alarm and recovery assistance device for signaling the parting of lines in tension. The apparatus comprises attachment means for securing different structures, e.g. tug boats and barges and boats and buoy, to one another, sensor means for signaling separation between the various structures beyond the limit set by the attachment means and a triggering means responsive to said sensor means for actuating signals such as flares both immediately and a preset intervals after the initial signal.

More particularly, the present invention provides a simple, safe and inexpensive means for immediately indicating breakage of attachment lines as the break occurs as well as time delayed signaling means for facilitating subsequent recovery of the severed structure.

In one embodiment, a sensor line in the form of a lanyard cable strung along the attachment or towing cable is releasably attached by quick-connect plugs to a flare alarm box affixed to the towed or moored structure. A triggering bar, protruding from said box, is connected to the lanyard cable by a shear pin. When the main attachment line parts, the lanyard cable will pull the triggering bar once separation between the attached structures exceeds the limit usually set by the attachment cable. The triggering bar, once pulled outward, permits a spring loaded firing pin to strike upward through appropriate openings into a flare storage cylinder, thereby setting off a conventional signal flare.

In a second embodiment of the present invention, a timing device is connected to one end of the triggering bar. Pulling the triggering bar now actuates not only a firing pin striking a first flare, or set of flares, but also starts said timing device. The timing device actuates a second triggering bar that sets off further flares at predetermined intervals.

In another embodiment of the present invention a pneumatic triggering device is employed which operates on compressed air. A combination of delay circuits may be added to act as a timing device wherein certain delay valves and volume chambers defer the triggering action of a pneumatic AND gate by a predetermined amount.

Yet another modification of the present invention employs a second signaling means, such as a radio transmitter, set on a distress frequency, or an acoustic signaling horn. This second signaling means is also activated by the sensor line or lanyard cable being pulled.

DESCRIPTION OF THE PREFERRED EMBODIMENTS

Figure 1:
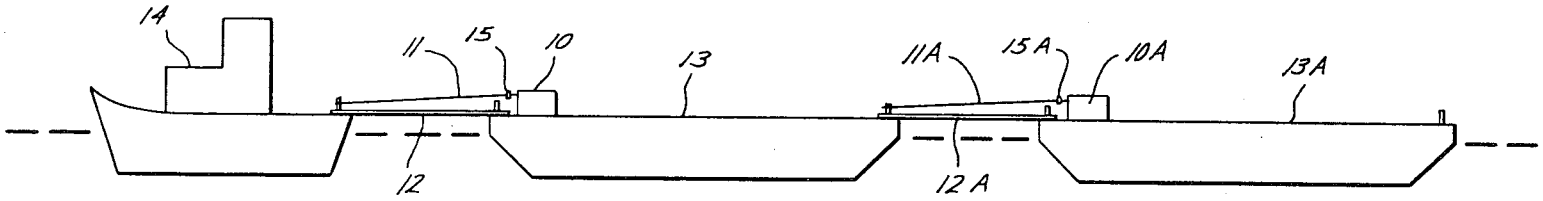
FIG. 1 is a view illustrating the flare signaling apparatus taught by the preferred embodiment of the present invention employed in barge towing operations.

Referring to the drawings, FIG. 1 illustrates diagrammatically how the present invention is used in barge towing. The flare alarm box of the present invention is generally indicated at 10. A lanyard cable 11 connects the actuating mechanism of barge and through a quick-connect device 15 to the rear of tug boat 14. A slightly shorter main attachment cable 12 is also attached to the front barge 13 and the rear of tug 14.

A main attachment cable 12A connects the rear of barge 13 to the front of barge 13A. The rear of barge 13 is also connected through second lanyard cable 11A through quick-connect device 15A to the flare alarm box 10A affixed to barge 13A.

Figure 2:
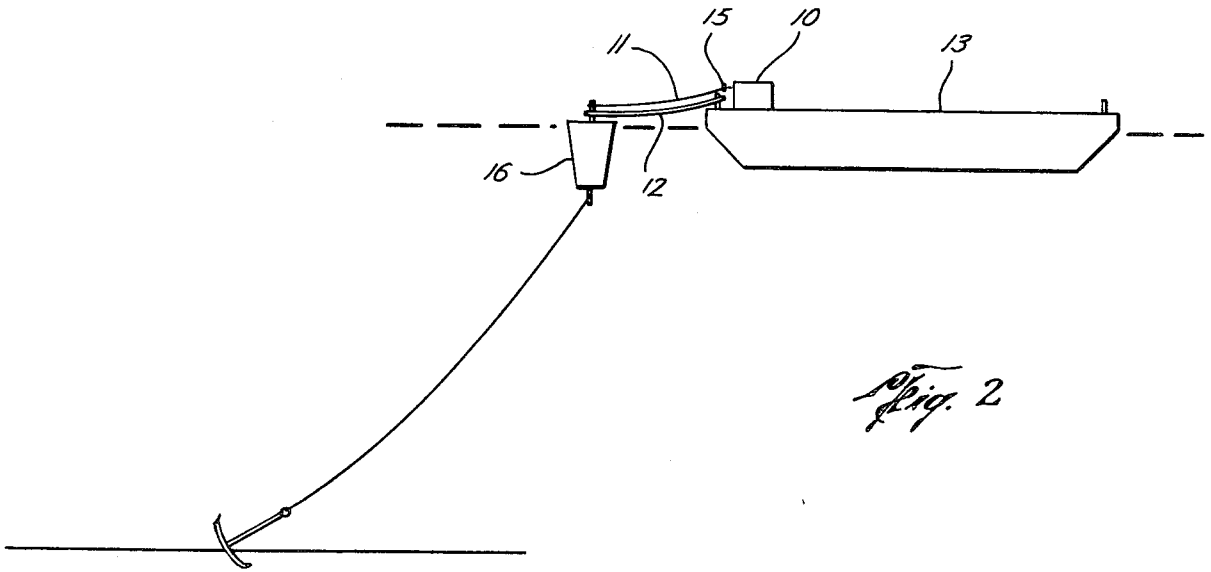
FIG. 2 illustrates employment of the preferred embodiment of the present invention used for mooring boats or barges.

Another use of the same basic elements is illustrated in FIG. 2 wherein barge 13 is moored via main attachment line 12 to an anchored buoy 16. Lanyard cable 11, which is also attached to buoy 16, is strung parallel to mooring line 12 and attached to flare alarm box 10, either directly or via a quick-connect plug 15, as described above.

Figure 3:
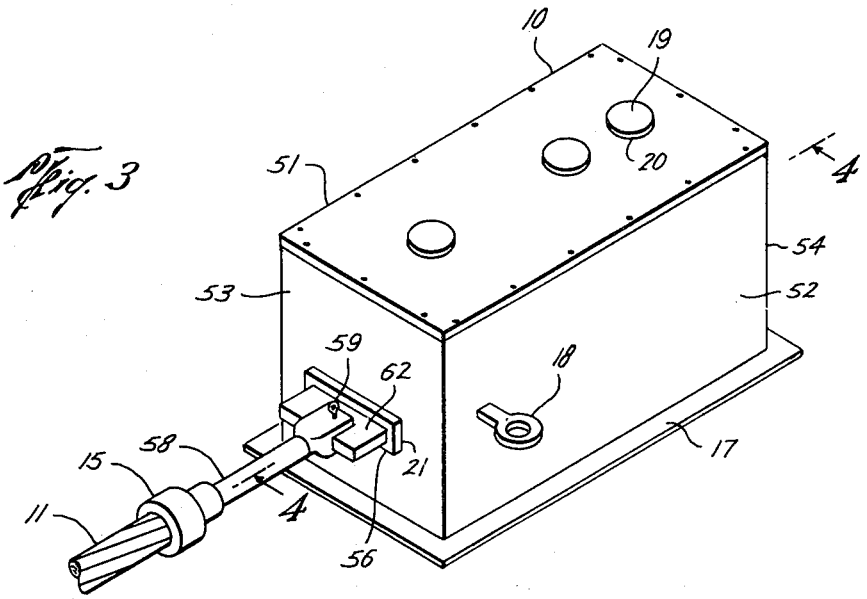
FIG. 3 is an enlarged illustration of the flare alarm box taught by the preferred embodiment of the present invention.
Figure 4:
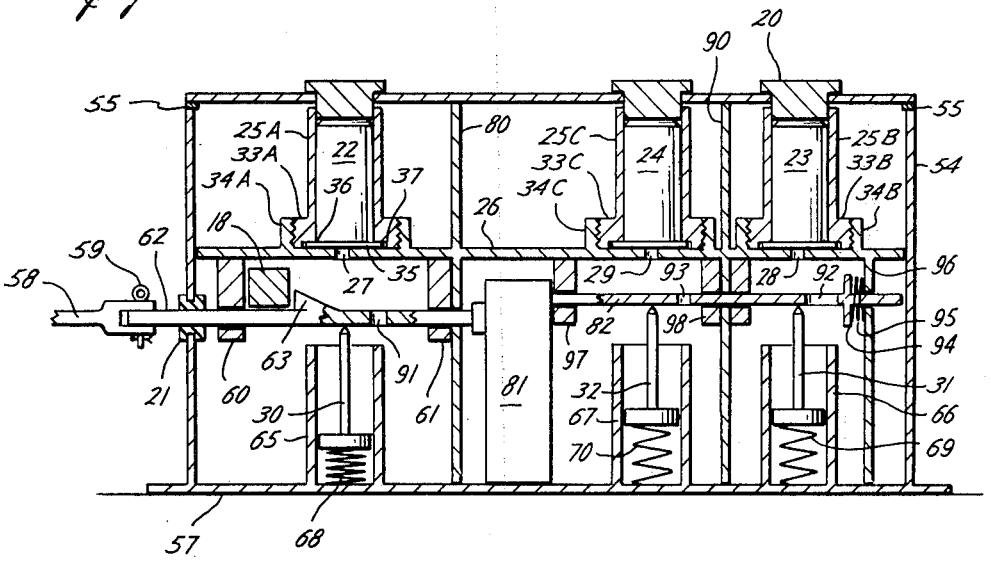
FIG. 4 is a cross-sectional view taken along the line A—A of FIG. 3 illustrating the internal construction of the flare alarm box of the present invention.

Referring to FIG. 3, flare alarm box 10 is depicted generally as being a rectangular box bolted or welded to barge 13 along its bottom edge 17. The top of box 10 defines a number of flare port openings 19 from which the flares are ejected once triggered and ignited. Such flare port openings 19 are protected against intrusion of water by plastic or rubber caps 20, which hermetically seal off the flare storage cylinder until they are ejected by a flare. For the sake of illustration, FIG. 3, as well as FIG. 4 show flare alarm box 10 as having three flare port openings, but, of course, the invention contemplates any number of flares and flare port openings as may be required by operational circumstances.

A safety stop 18 is shown protruding from one of the sidewalls 52 of box 10. Safety stop 18, when inserted, prevents accidental firing of flares during adjustment or hook-up operations. The internal triggering mechanism of flare alarm box 10 is effectively blocked and not rendered operative unless and until safety stop 18 is released.

Trigger bar 62 extends outside box 10 through opening 56 of box 10. Trigger bar 62 is attached to lanyard cable 11 by quick-connect plug 15. Quick-connect plug 15 is connected to bar 62 by short cable 58 and shear pin 59, which passes through a hole in bar 62 (not shown). Trigger bar opening 56 is sealed against the intrusion of water into the interior of box 10 by rubber gasket 21.

The top plate 50 of flare alarm box 10 is releasably attached to sidewalls 51, 52 and front plate 53 and rear plate 54 by means of bolts, screws or other removable fasteners to provide access to the interior of box 10 for the purpose of loading flares, removing expended shells and general maintenance.

The internal mechanism of flare alarm box 10 of one of the preferred embodiments of the present invention can best be described with reference to FIG. 4. Flares 22, 23 and 24 are shown in their respective flare storage cylinders 25A, 25B and 25C. The flare storage cylinders 25A, 25B and 25C. The flare storage cylinders themselves are mounted on an internal partition 26. Within each flare storage cylinders 25A, 25B and 25C concentrically located pin hole openings 27, 28 and 29, respectively, penetrate platform 26 in register with the flares firing caps or primers providing access through these openings for firing pins 30, 31 and 32, respectively, once the triggering mechanism is released. The flare storage cylinders themselves are provided with protruding, externally threaded, lower flange portions 33A, 33B and 33C, respectively, which releasingly engage with matchingly threaded rings 34A, 34B and 34C, which are welded to platform 26.

Upon removal of top plate 50, which is removable attached to box 10 with gasket 55 therebetween to hermetically seal off the interior, access to said interior containing platform 26 and flare storage cylinders 25A, 25B and 25C can be had from the top. The cylinders can then be unscrewed from their mounting rings to permit loading of flares. An annular groove 36 is provided at the bottom end of flare storage cylinder 25, wider in diameter than the flare itself. These grooves accommodate the hop 37 of firing cap 35 at the bottom of the flare cartridge and provide sufficient mechanical restraint along shoulder 37 to permit a firing pin to penetrate the cap and set off the flare.

In one of the preferred embodiments the triggering mechanism would consist of one directly activated, mechanical trigger bar 62 and a separate spring loaded timing device 81, which in turn activates a second mechanical trigger bar 82 after some suitably set time delay.

The first trigger bar 62 is slideably mounted between guides 60 and 61 and is attached at one end by shear pin 59 to connector bar 58 and at the other end to the schematically indicated timed firing device 81. Trigger bar 62 is equipped with pin hole opening 91 and a triangular protrusion 63, which abuts safety stop 18 so long as the safety stop is inserted in box 10. When safety stop 18 is disengaged, trigger bar 62 is free to slide forward when pulled by cable 11 so as to bring firing pin passage 61, firing pin 30 and firing pin passage 27 into operative alignment. Firing pin 30 is mounted atop spring coil 68 which in turn is mounted within spring cylinder 65 attached to the base plat 57. When trigger bar 62 is pulled out of box 10 then firing pin passages 61 and 27 are in vertical alignment and spring pressure from coil 68 will drive firing pin 30 upward causing it to strike firing cap 35 and set off flare 22.

Trigger bar 62, when moved to fire flare 22, will also start timing device 81. Timing device 81 comprises any clockwork, spring loaded or otherwise activated mechanism capable of either pulling forward or of restricting the forward motion of second trigger bar 82. Only the release form of timing mechanism is shown in FIG. 4. As shown, second trigger bar 82 is slidably mounted between guides 97 and 98 and section plate 96. A coiled spring 95 is inserted between wall 96 and backstop 94, which is formed in the terminal end of trigger bar 82. Spring 95 is under compression, and provides the driving force for moving bar 83 so firing openings 92 and 93 are in alignment with firing pins 31 and 32. In the embodiment shown in FIG. 4, firing pin openings 92 and 93 are arranged in such a way that in their initial rest position pin 31 is located closer to opening 93 than the pin 32 is to opening 93. As shown, firing pin 31, housed in cylinder 66 and driven by spring 69, would be the first to reach and set off its flare 23 when trigger bar 82 moves forward under the control of timing device 81, i.e. at some first time interval after being triggered by first trigger bar 62. Firing pin opening 92 is in the form of an elongated rectangular slot rather than a circular opening, to permit further movement of bar 82 after flare 23 has been ignited. Thus, when the timing device 81 permits spring 95 to push bar 82 forward to its ultimate rest position, firing pin 31 will be in slot 92 and will not interfere with the triggering of flare 24.

Figure 5:
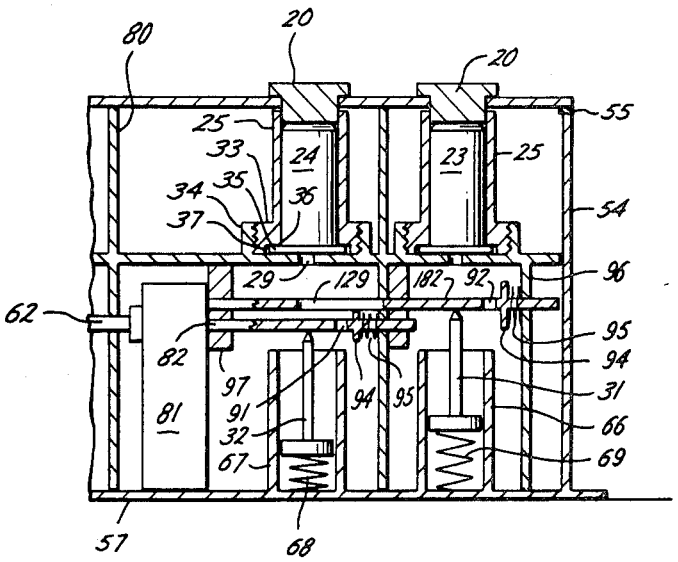
FIG. 5 is a cross-sectional view of an alternative embodiment of the time delayed triggering mechanism.

Another embodiment of the present invention's time delayed recovery-assistance flare triggering mechanism is shown in FIG. 5. In that variation of the preferred embodiment, timing device 81 activates two trigger bars 82 and 182. An extended secondary firing pin slot 129 along secondary trigger bar 182 permits either flare 23 or 24 to be set off before the other, depending solely upon the setting of the internal release mechanism of timing device 81.

Figure 6:
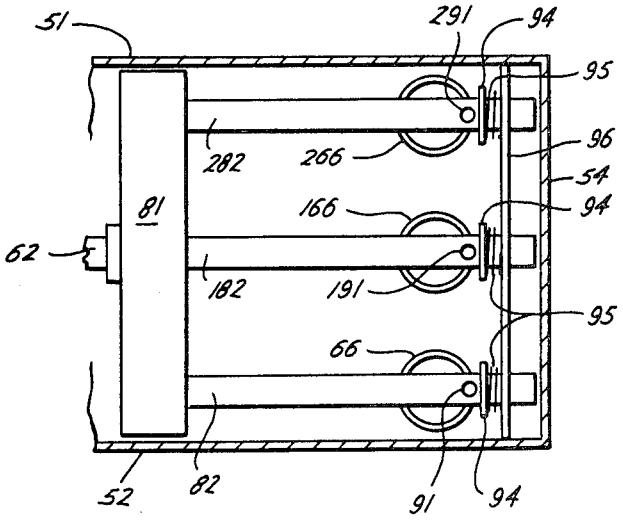
FIG. 6 is a top partially cut away of yet another embodiment of the present invention illustrating a parallel firing arrangement for delayed recovery-assistance flares.

FIG. 6 shows a top view of yet another variation of the preferred embodiment. Since circumstances may require a large number of flares to be set off at time intervals, i.e. where one might reasonably anticipate particularly difficult recovery conditions, arranging all flares in series behind timing device 81 might result in flare boxes that are too long to be placed on the barge's deck. The invention solves this problem by providing parallel rows of flares and trigger bars. A parallel arrangement of three such trigger bars 82, 182 and 282 is shown in FIG. 6. Also depicted are their respective firing pin openings 91, 191 and 291 as well as the corresponding firing pin spring cylinders 66, 166 and 266. The firing sequence of the flares in this arrangement is again determined wholly by various settings of the internal release mechanism of timing device 81. Of course, different combinations of parallel and in-series arrangements of flares could also be used wherever necessary or desirable.

Figure 7:
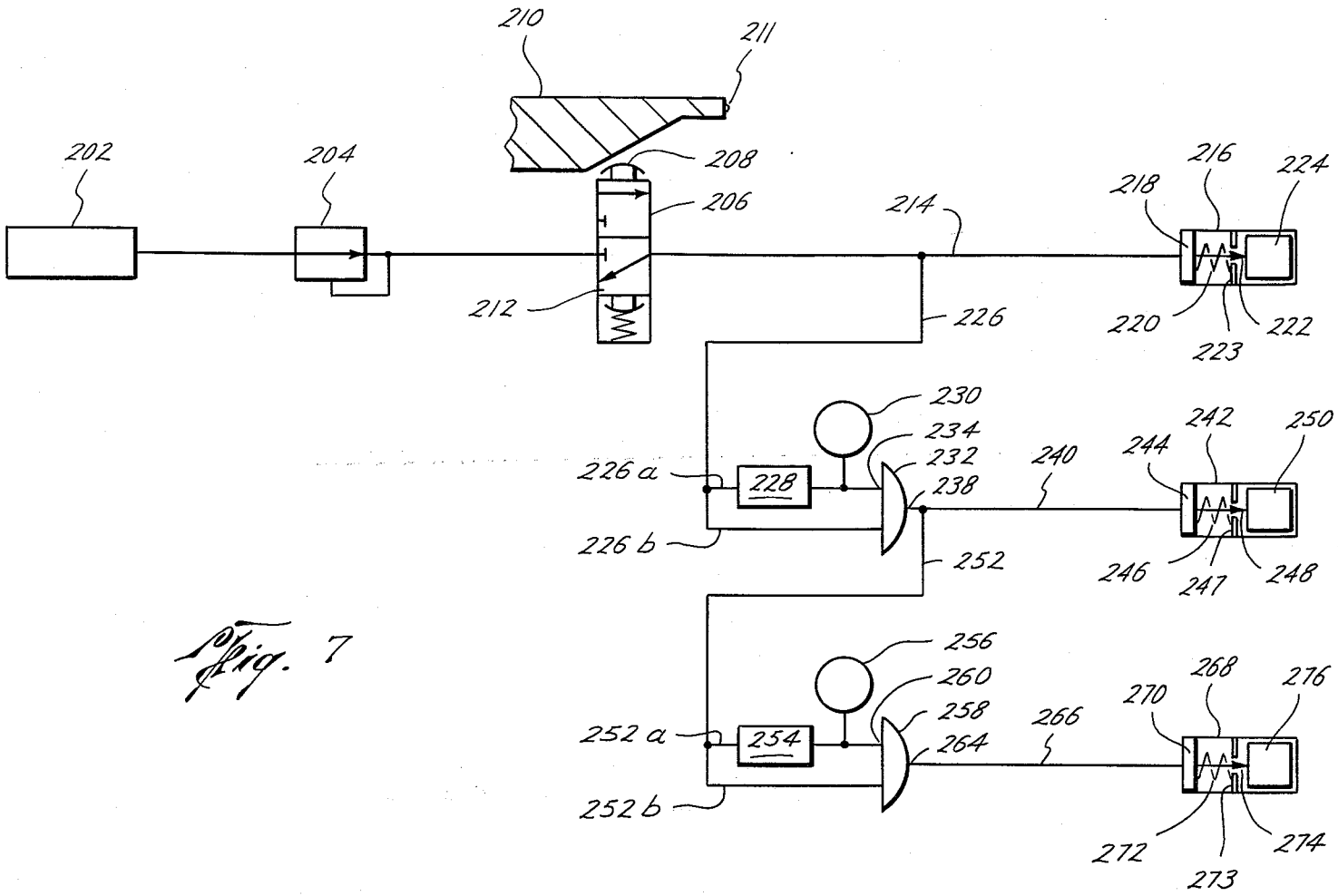
FIG. 7 is a schematic diagram of another embodiment of the present invention employing pneumatic triggering means and pneumatically operated time delay mechanisms.

Another variation of the preferred embodiment of the present invention is shown schematically in FIG. 7. To avoid mechanical mishaps under the highly corrosive conditions of the environment within which the flare signalling system of the present invention is commonly used, a pneumatic trigger and timing device may be employed within flare alarm box 10.

Compressed air is stored at a high pressure in air tank 202 and is regulated through regulator valve 204 feeding into trigger valve 206 with a reduced pressure of 50–60 psi. The regulator used in the preferred embodiment of the present invention is a Veriflo regulator model number IR401B, manufactured by the Veriflo Company in Richmond, Calif. The trigger valve 206 is equipped with a safety lock 212 preventing accidental firing and must be depressed from the safety position shown in FIG. 7 before it can feed compressed air into fire flare firing line 214. Valve 206 in the preferred embodiment of the present invention is a Humphrey valve model 41-PP, manufactured by the Humphrey Company in Calamazoo, Mich. Its cap 208 is depressed by the slanted portion of trigger bar 210 which is schematically shown in FIG. 7 as being connected to lanyard cable 11 at 211 in the manner described above.

Valve 206, when fully depressed by trigger bar 210, will permit the passage of compressed air into line 214 and hence into flare storage cylinder 216. Flare storage cylinder 216 houses a pneumatic piston 218 which, upon the opening of compressed air flow through trigger valve 206, will depress spring 220 against partition 223 and drive firing pin 222 into flare 224, setting it off in the previously described manner. As in the earlier described preferred embodiment of the present invention more than one flare may be housed within alarm box 10 and these flares, if set off in exactly timed intervals, will aid in the recovery of a detached boat or vehicle. Pneumatic circuits such as the one schematically set forth in FIG. 7, easily lend themselves to such time-delayed triggering functions. To that end, line 214 is connected to parallel delay circuits of which, for convenience sake, only two are shown in FIG. 7. Time-delay feed line 226, connected to direct firing line 214, branches out into two separate lines **226*a* and 226*b*, leading to the two parts 234 and 236, respectively, of AND gate 232. AND gate 232, which in the preferred embodiment of the present invention is an Aro gate, model number 59111, manufactured by the Aro Company in Brian, Ohio, is connected at gate 234 to a volume chamber 230 and a delay valve 228. Compressed air entering time delay line 226*a* must first pass through delay valve 228, which is an Aro time-delay variable needle valve, model number 59115, manufactured by the Aro Company, Brian, Ohio. It is therein throttled to such an extent that it will take a precisely predetermined amount of time to fill volume chamber 230 to 75% of the supply pressure present in lines 214 and 226. The signal port 234 will be triggered at 75% of the supply line pressure and will permit flow through output line 238 into second firing line 240. Firing line 240 in turn feeds into flare storage cylinder 242 housing piston 244, spring 246, partition 247, firing pine 248 and second signal flare 250, all of which cooperate as described above. In addion, AND gate 232 output line 238 feeds into second delay circuit line 252 which in turn branches out into AND gate supply lines 252*a* and 252*b* being connected to delay valve 254, volume chamber 256, signal port 260 of AND gate 258 and supply part 262 of AND gate 258, respectively in a manner exactly analogous to the one set forth with respect to the first delay circuit above. Once again, upon reaching 75% of supply line pressure, AND gate 258 will open and its output port 264 will permit air to feed through firing line 266 into flare storage cylinder 268. Flare storage cylinder 268, in turn, is identical to cylinders 250 and 224 described above, housing piston 276, spring 272, partition 273, firing pine 274 and flare 276** all of which cooperate in the previously described fashion.

The above embodiments of the present invention are only illustrative of alarm signaling means especially helpful for seafaring usage. Clearly, towing operations on land could also benefit from the described invention's simple mechanical signaling mechanism responsive to immediate separation between towed and towing vehicles and/or permitting time delayed alarm signal emissions for subsequent recovery. To that end, other commonly known alarm signaling means such as flashing lights, acoustic horns or sirens, or intermittent radio signal could all be employed in conjunction with the described alarm signaling and triggering means.

It should be appreciated from the foregoing disclosure that the description of the present invention is primarily illustrative and explanatory thereof, and that various changes in size, shape, arrangement and materials as well as in the details of the illustrated construction may be made within the scope of the appended claims and their equivalents without departing from the present invention.

I claim:

1. An apparatus for signalling separation between a first structure and a second structure, comprising:

attachment means for connecting the first structure and the second structure, said attachment means including an elongated member of a predetermined length;

signalling means responsive to the disconnection of said attachment means for indicating said disconnection, said signalling means including a lanyard cable running parallel to said attachment means, said lanyard cable being substantially the same length as said elongated member, said length of said lanyard cable being such that said lanyard cable is subjected to tension stresses after said disconnection of said attachment means;

an alarm box attached to the second structure, including alarm means for alerting operators of said disconnection of said attachment means substantially immedicately upon the happening of said disconnection; and triggering means comprising a trigger bar, said lanyard cable being removably attached to said trigger bar;

said trigger bar extends into the interior of said alarm box thereupon depressing and opening a pneumatic safety valve when said tirgger bar is pulled out of said alarm box by said lanyard cable; and said triggering means includes a compressed air tank supplying pressure to a regulator valve and said pneumatic safety valve, both controlling a pneumatic piston which drives a firing pin into a signal flare when said safety valve is opened to compressed air flow from said air tank.

2. An apparatus for signalling separation between a first and a second structure and for relocating said second structure, comprising:

an attachment means for connecting the first structure and the second structure;

signalling means responsive to the disconnection of said attachment means for indicating said disconnection;

said attachment means including an elongated member of a predetermined length, said signalling means including a lanyard cable running parallel to said attachment means, said lanyard cable being substantially the same length as said elongated member, said length of said lanyard cable being such that said lanyard cable is subjected to tension stresses after said disconnection of said attachment means;

an alarm box attached to the second structure including alarm means for alerting operators of said disconnection of said attachment means and for assisting in the subsequent recovery of the second structure;

triggering means for activating said alarm means, said triggering means being connected to said signalling means, said triggering means being activating by said signalling means; said signalling means including a trigger bar, said lanyard cable being removably attached to said trigger bar, said trigger bar extending into the interior of said alarm box therein depressing and opening a pneumatic safety valve when said trigger bar is pulled out of said alarm box by said lanyard cable, said triggering means including a compressed air tank supplying pressure to a regulator valve, said pneumatic safety valve cooperating with a pneumatic piston which drives a firing pin into a signal flare; and a timing device within said alarm box for triggering at least one other of said alarm means sometime after said disconnection of said attachment means, said trigger bar being connected with said timing device such that the trigger bar triggers said timing device when said trigger bar is pulled out of said alarm box on said disconnection of said attachment means.

3. A device of claim 2 wherein:

said timing device includes a pneumatic delay valve, a volume chamber, and a pneumatic AND gate;

the pneumatic output of said pneumatic safety valve is placed in fluid connection with the input of said delay valve, said volume chamber and said pneumatic AND gate, the pneumatic output of said AND gate can be placed in fluid connection with a flare storage cylinder containing a pneumatic piston, said pneumatic piston being equipped with a firing pin capable of firing a signal flare when air from the pneumatic AND gate is supplied to the flare storage cylinder.

4. A device of claim 3 wherein said timing device includes a plurality of pneumatic delay circuits, each comprising a pneumatic delay valve, a volume chamber and a pneumatic AND gate, the pneumatic output of the pneumatic AND gate of each of said pneumatic delay circuits can be placed in fluid communication with a separate flare storage cylinder.

* * * * *